US006896175B2

(12) United States Patent
Duke et al.

(10) Patent No.: US 6,896,175 B2
(45) Date of Patent: May 24, 2005

(54) CARTON DIVIDER

(75) Inventors: Norman Duke, Whitby (CA); Terry Duke, Raglan (CA)

(73) Assignee: Corrugated Partitions Inc., Ontario (CA)

( * ) Notice: Subject to any disclaimer, the term of this patent is extended or adjusted under 35 U.S.C. 154(b) by 0 days.

(21) Appl. No.: 10/687,876

(22) Filed: Oct. 20, 2003

(65) Prior Publication Data

US 2004/0256447 A1 Dec. 23, 2004

(30) Foreign Application Priority Data

Oct. 21, 2002 (CA) ..... 2409061

(51) Int. Cl.[7] ..... B65D 5/495
(52) U.S. Cl. ..... 229/120.36; 229/120.38
(58) Field of Search ..... 229/120.36, 120.38; 217/22, 30, 31, 32

(56) References Cited

U.S. PATENT DOCUMENTS

| | | | | | |
|---|---|---|---|---|---|
| 456,353 | A | * | 7/1891 | Bower | 217/32 |
| 654,508 | A | * | 7/1900 | Bohn | 217/32 |
| 1,443,283 | A | * | 1/1923 | Showalter | 217/31 |
| 1,978,719 | A | * | 10/1934 | Parnin | 217/32 |
| 1,995,482 | A | * | 3/1935 | Piautz | 217/30 |
| 2,673,656 | A | * | 3/1954 | Cunningham | 217/32 |
| 3,120,413 | A | * | 2/1964 | Scotti | 217/31 |
| 3,371,840 | A | * | 3/1968 | Schlager et al. | 229/120.36 |
| 3,767,106 | A | * | 10/1973 | Morgan | 229/120.36 |
| 4,492,332 | A | * | 1/1985 | Collins | 229/120.36 |
| 4,591,090 | A | * | 5/1986 | Collins et al. | 229/120.36 |
| 4,795,083 | A | * | 1/1989 | Johnske | 229/120.36 |
| 5,518,171 | A | * | 5/1996 | Moss | 229/120.36 |

FOREIGN PATENT DOCUMENTS

| | | | | | |
|---|---|---|---|---|---|
| JP | 2-72043 | A | * | 3/1990 | 217/31 |

* cited by examiner

*Primary Examiner*—Gary E. Elkins
(74) *Attorney, Agent, or Firm*—Birch, Stewart, Kolasch & Birch, LLP

(57) ABSTRACT

The divider is composed of a number of strips, at least one of which extends longitudinally and another of which extends transversely. The strips have slots for interconnecting the strips. Each slot is defined by spaced apart side edges which extend generally vertically from the top edge of the strip to an intermediate portion and which extend further to a terminal portion. Each strip has a thickness which is greater than the distance which separates the side edges of the slot in the intermediate portion but which is less than the distance which separates the side edges of the slot in the terminal portion.

16 Claims, 5 Drawing Sheets

CARTON DIVIDER

FIELD OF THE INVENTION

This invention relates to collapsible dividers for cartons composed of corrugated or solid fibre or plastic and more particularly to a divider which resists separating into its component parts when it is being assembled in a carton or being turned upside down and which folds into a compact shape when being stored.

BACKGROUND OF THE INVENTION

Dividers are commonly used in conjunction with cartons for packing articles which are shipped in bulk. The dividers serve to separate the articles from one another and to increase the stacking strength of the carton. Drinking glasses and bottles containing alcoholic beverages and non-alcoholic beverages are commonly shipped in this way. Usually the dividers are composed of corrugated or solid fibre or plastic interconnected by means of tabs, slots and holes.

A shortcoming of many dividers is that they do not remain interconnected while they are being assembled in a carton or when they are being turned upside down. Assembly of the dividers in a carton is difficult if the dividers do not remain interconnected at this time. Removal of articles from a carton likewise is difficult if the dividers come apart. The reason is that articles are frequently removed by turning the carton upside down. If the dividers come apart at this time, the articles may fall over and break if the articles are bottles, or become wedged into the carton by the dividers and not discharge at all.

SUMMARY OF THE INVENTION

We have invented a collapsible divider for a carton which substantially overcomes this shortcoming. The divider is an improvement over a conventional divider composed of a plurality of strips, at least one of which extends longitudinally and another of which extends transversely. The strips are interconnected with one another and each has oppositely facing upper and lower horizontally extending edges and at least one slot which extends from an opening in one edge. The improvement is in the shape of the slot. The slot is defined by spaced apart side edges which extend generally vertically from the opening to an intermediate portion and which extend further to a terminal portion. Each strip has a thickness which is greater than the distance which separates the side edges of the slot in the intermediate portion but which is less than the distance which separates the side edges of the slot in the terminal portion.

DESCRIPTION OF THE DRAWINGS

The carton divider of the invention is described with reference to the accompanying drawings in which.

Like reference characters refer to like parts throughout the description of the drawings.

DESCRIPTION OF PREFERRED EMBODIMENTS

Figure 1:
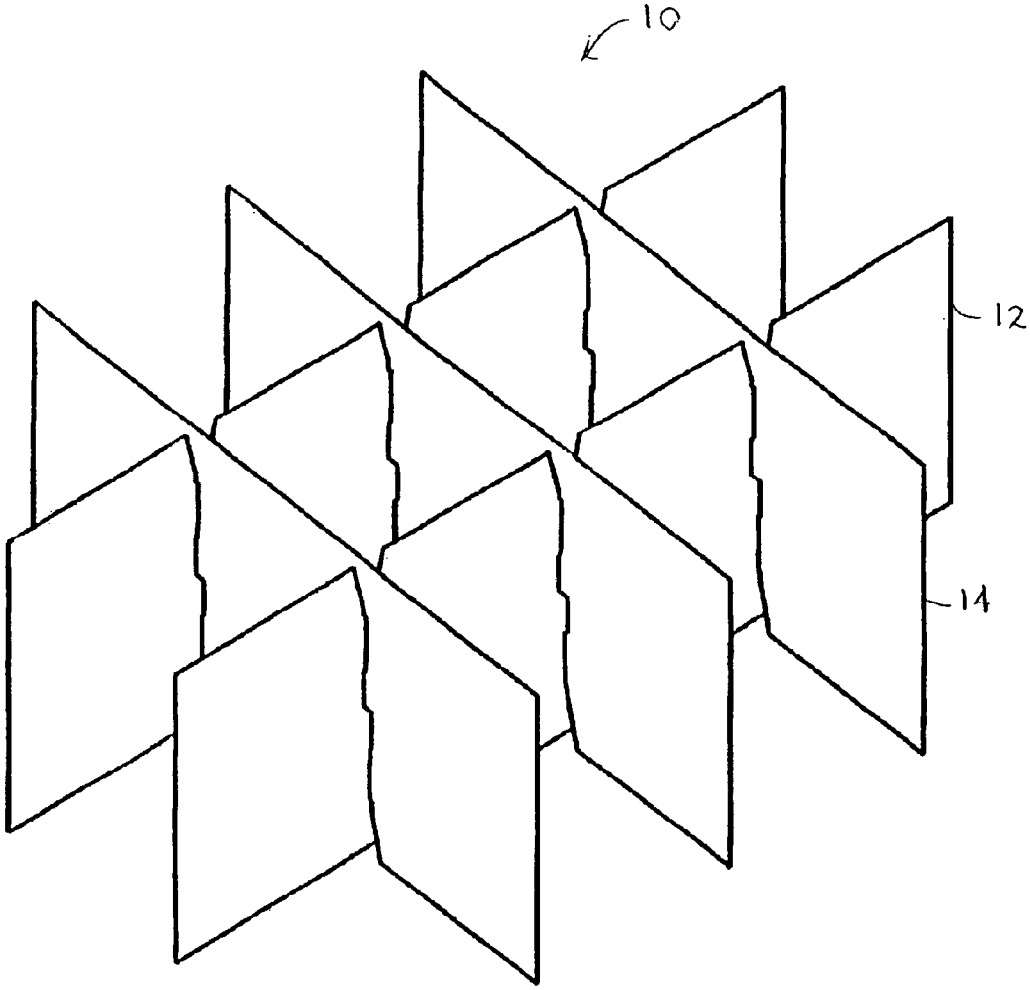
FIG. 1 is a perspective view of an assembled carton divider.
Figure 2:
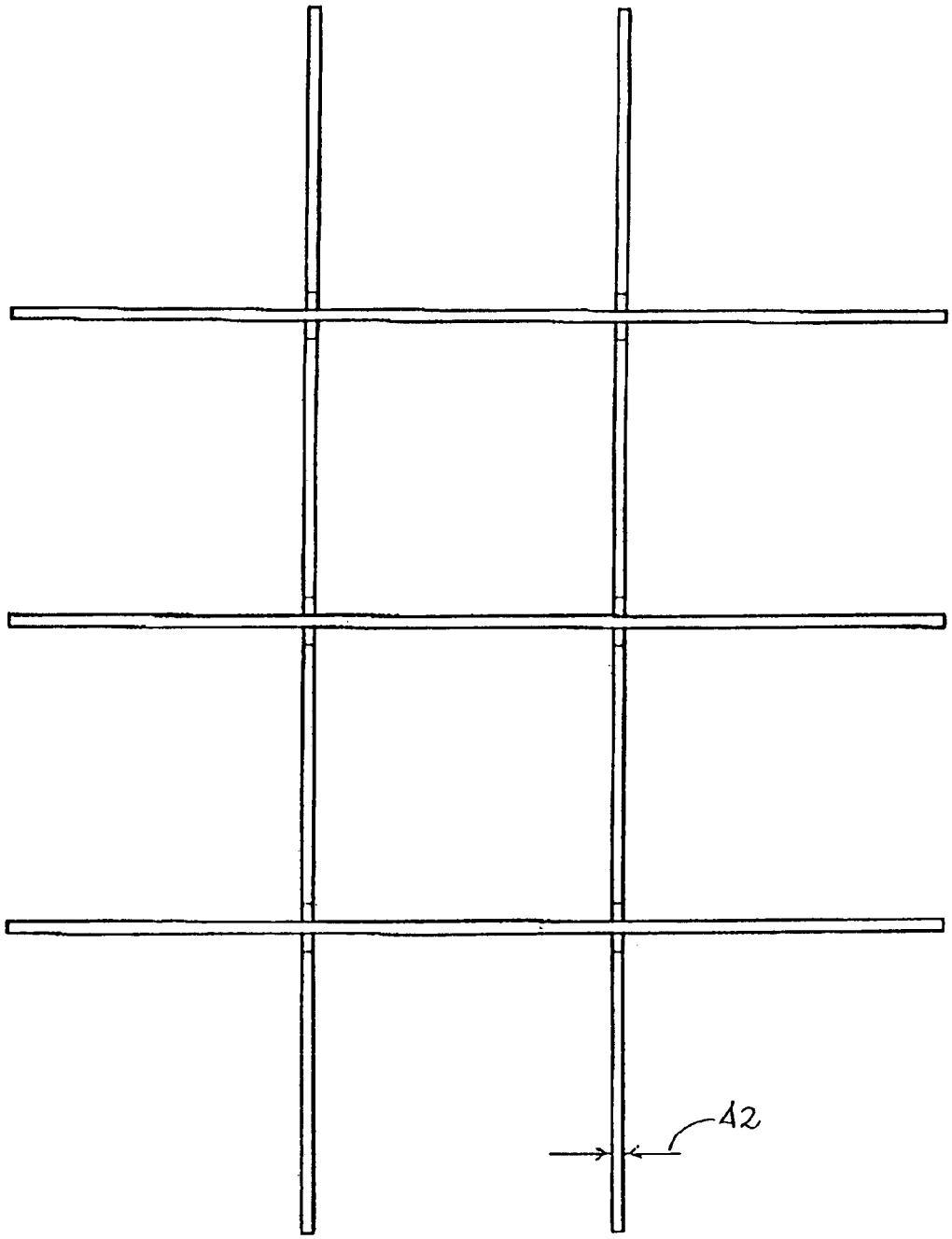
FIG. 2 is a plan view of the divider.

With reference to FIGS. 1 and 2, the carton divider, indicated generally 10, is used in conjunction with a conventional carton composed of corrugated or solid fibre or plastic and is used for packing articles which are shipped in bulk such as glasses and bottles. Cartons used for this purpose are well known and are not illustrated herein.

The divider is composed of two sets of strips which extend in two directions normal to one another. One set 12 extends longitudinally and another set 14 extends transversely. The strips in each set are parallel to one another.

Figure 3:
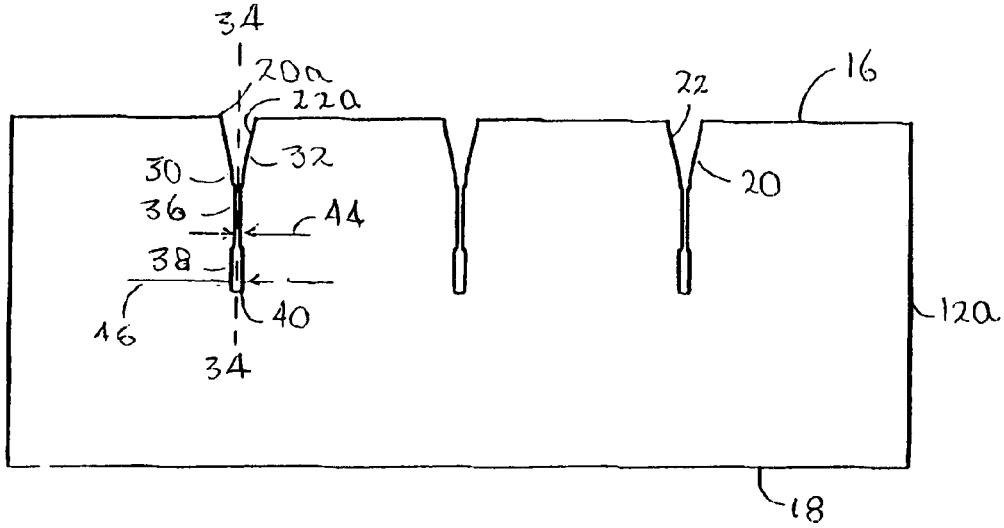
FIG. 3 is an elevation of a strip.
Figure 4:
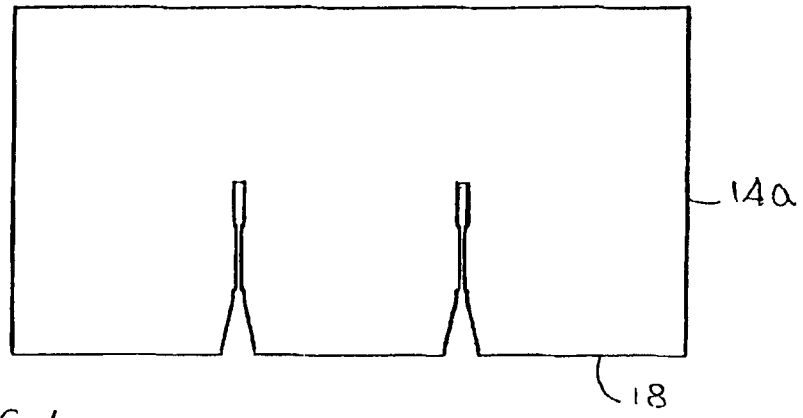
FIG. 4 is a partial elevation of another strip which interconnects with the strips of FIG. 3.

With reference to FIGS. 3 and 4, the strips in each set have oppositely facing upper and lower horizontally extending edges 16, 18. Slots 20 extends from opening 22 in one edge. In longitudinal strip 12*a* the slots extend vertically downward from the upper edge 16 while in transverse strip 14*a* the slots extend vertically upward from the lower edge 18. The slots end mid-way between the upper and lower edges.

Figure 5:
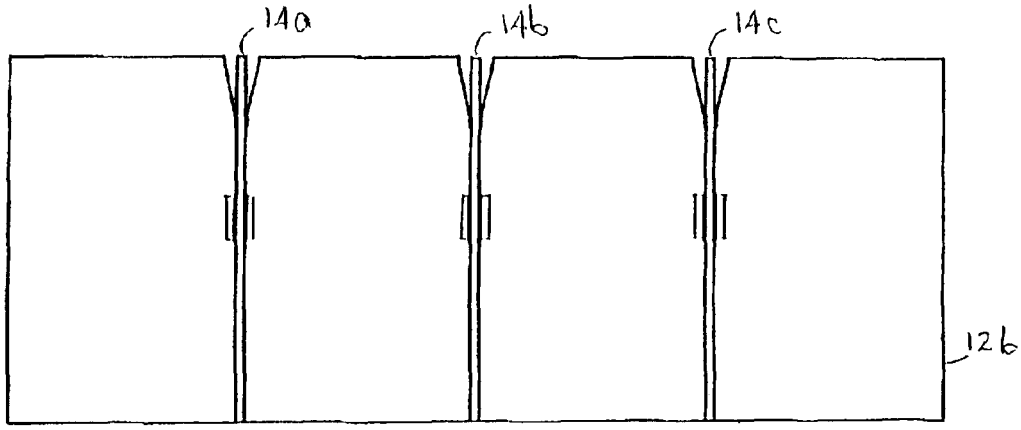
FIG. 5 is an elevation of a strip and an end view of strips connected to the latter strip.

With reference to FIG. 5, longitudinal strip 12*b* is interconnected with three transverse strips 14*a,b* and *c*. As is conventional, the strips are connected by placing each transverse strip on top of the longitudinal strip and aligning a slot in the transverse strip with a slot in the longitudinal strip. The transverse strip is then pushed downward to cause the two strips to enter each other's slots until the upper and lower edges of both strips are in the same planes. The two strips will then be interconnected.

With reference again to FIG. 3, slot 20*a* is defined by spaced apart side edges 30, 32 which are symmetrically disposed about an imaginary longitudinal axis 34–34. The side edges extend generally vertically downward from opening 22*a* to an initial portion and then continue to an intermediate portion 36. The side edges of the slot in that portion are parallel to each other and vertically extending. Beneath the intermediate portion the side edges define a terminal portion 38 and beneath the latter portion, the side edges terminate at a base 40. The base is approximately mid-way between the upper and lower edges 16, 18 of the strip.

When the strip illustrated in FIG. 3 is interlocked with another strip, as illustrated in FIG. 5, the side edges of the slots in the intermediate portions of the interlocked strips are aligned with one another.

As illustrated in FIGS. 3 and 5, the longitudinal axis 34–34 of each slot in the longitudinally extending strip is aligned with the longitudinal axis of a separate slot in a transversely extending strip when the longitudinally and transversely extending strips are interconnected. The slots having aligned axes are separated from one another by a space through which the aligned axes pass.

With reference to FIG. 3, each strip has a thickness 42 which is greater than the distance 44 which separates the side edges of the slot in the intermediate portion. In that way there is a friction fit between a strip in the slot and the strip having the slot. The thickness of the strip is however less than the distance 46 which separates the side edges of the slot in the terminal portion. The slot being wider at this portion allows the divider to be opened and closed easily. When the divider is closed, it is substantially flat while the strips remain securely interconnected.

Figure 6:
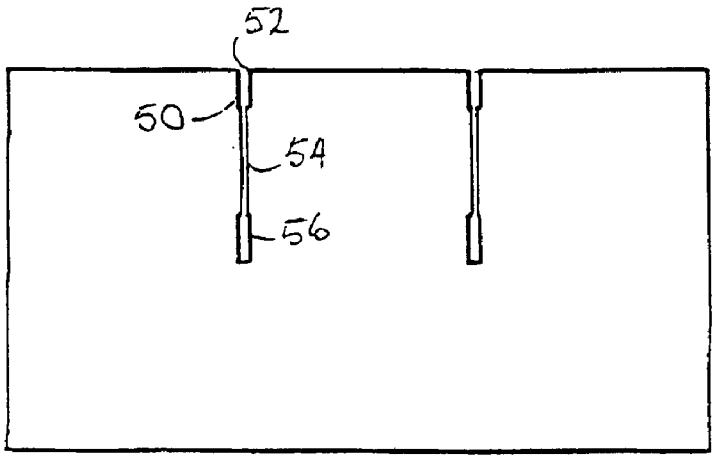
FIGS. 6 to 9 are further embodiments of the strip partition.

With reference to FIG. 6, slot 50 is the same as slot 20 in FIG. 3 except that its opening 52 is narrower than that of slot 20. Its intermediate and terminal portions 54, 56 are however the same as those of portions 36, 38 of FIG. 3.

Figure 8:
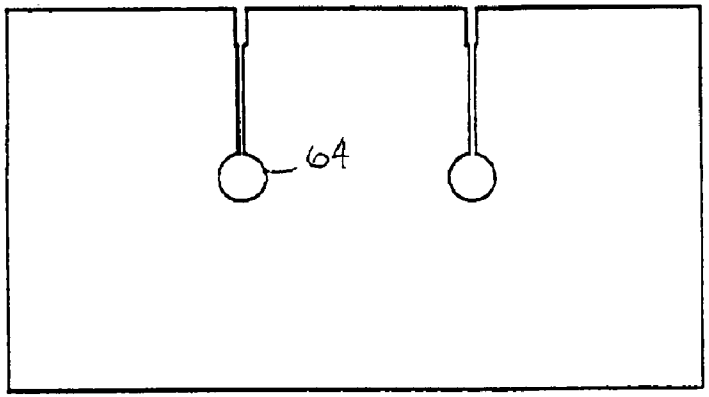
Figure 7:
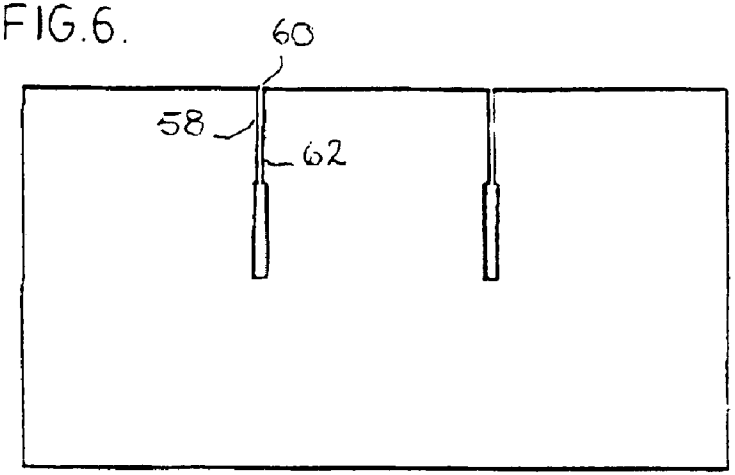
Figure 9:
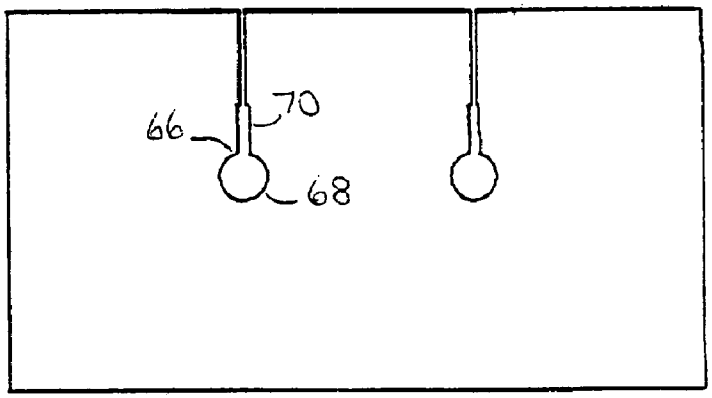

In FIG. 7, slot 58 has an opening 60 which is the same width as that of intermediate portion 62. In FIG. 8, the side edges of the terminal portion 64 are circular whereas in FIG. 9, the side edges of the terminal portion 66 are partly circular at 68 and partly straight at 70.

In the slots illustrated in FIGS. 6 to 9, the distance between the side edges at the intermediate portions of the slots is less than the thickness of the strip and the distance between the sides edges at the terminal portions is more.

It will be understood, of course, that modifications can be made in the embodiments of the carton divider of the invention without departing from the scope and purview of the invention.

We claim:

1. In a collapsible carton divider comprised of a plurality of strips, at least one of which extending longitudinally and another of which extending transversely and being interconnected with one another, each said strip having oppositely facing front and rear walls, oppositely facing upper and lower horizontally extending edges and at least one slot which extends from one said edge toward the other said edge, the improvement wherein said at least one slot is defined by spaced apart side edges having an initial portion which commences at one said horizontally extending edge and extends generally vertically to an intermediate portion, and which extend further to a terminal portion, said intermediate portion having a substantial length and terminating short of the midway point between said horizontally extending edges, each said strip having a thickness which is greater than the distance which separates the side edges in said intermediate portion of said at least one slot but which is less than the distance which separates the side edges of said terminal portion of said at least one slot, the former said distance being uniform throughout the length of said intermediate portion, the intermediate portion of said at least one slot of one said strip being in contact with the front and rear walls of another said strip to which said one strip is connected.

2. The collapsible carton divider of claim 1 wherein said at least one slot has a longitudinal axis, the longitudinal axis of at least one slot in said longitudinally extending strip being aligned with the longitudinal axis of a separate slot in said transversely extending strip when said longitudinally and transversely extending strips are interconnected, said slots having aligned axes being separated from one another by a space through which said aligned axes pass.

3. The collapsible carton divider of claim 1 wherein the side edges in the initial portion of said at least one slot converge toward said intermediate portion.

4. The collapsible carton divider of claim 1 wherein the side edges in the initial portion of said at least one slot are parallel to one another.

5. The collapsible carton divider of claim 1 wherein the side edges in the terminal portion of said at least one slot are parallel to one another.

6. The collapsible carton divider of claim 1 wherein the side edges in the terminal portion of said at least one slot are circular.

7. The collapsible carton divider of claim 1 wherein the side edges in the terminal portion of said at least one slot are partly parallel to one another and partly circular.

8. The collapsible carton divider of claim 1 wherein the side edges in the initial portion of said at least one slot are spaced apart substantially the same distance as the side edges in the intermediate portion of said at least one slot.

9. In a collapsible carton divider comprised of a plurality of strips, at least one of which extending longitudinally and another of which extending transversely and being interconnected with one another, each said strip having oppositely facing front and rear walls, oppositely facing upper and lower horizontally extending edges and at least one slot which extends from one horizontally extending edge toward the other horizontally extending edge, the improvement wherein said at least one slot in said transversely extending strip is defined by spaced apart edges having an initial portion which commences at one said horizontally extending edge and extends generally vertically to an intermediate portion, and which extend further to a terminal portion, said intermediate portion having a substantial length and terminating short of the mid way point between said horizontally extending edges, each said strip having a thickness which is greater than the distance which separates the side edges of said at least one said slot in said intermediate portion but which is less than the distance which separates the side edges in said terminal portion of said at least one slot, the former said distance being uniform throughout the length of said intermediate portion, the intermediate portion of said at least one slot of said transversely extending strip being in contact with the front and rear walls of one said longitudinally extending strip to which said transversely extending strip is connected.

10. The collapsible carton divider of claim 9 wherein said at least one slot in said horizontally extending strip has a longitudinal axis, the longitudinal axis of said at least one slot in said longitudinally extending strip being aligned with the longitudinal axis of a separate said slot in said transversely extending strip when said longitudirnally and transversely extending strips are interconnected, said slots having aligned axes being separated from one another by a space through which said aligned axes pass.

11. The collapsible carton divider of claim 9 wherein the side edges in the initial portion of said at least one slot converge toward said intermediate portion.

12. The collapsible carton divider of claim 9 wherein the side edges in the initial portion of said at least one slot are parallel to one another.

13. The collapsible carton divider of claim 9 wherein the side edges in the terminal portion of said at least one slot are parallel to one another.

14. The collapsible carton divider of claim 9 wherein the side edges in the terminal portion of said at least one slot are circular.

15. The collapsible carton divider of claim 9 wherein the side edges in the terminal portion of said at least one slot are partly parallel to one another and partly circular.

16. The collapsible carton divider of claim 9 wherein the side edges in the initial portion of said at least one slot are spaced apart substantially the same distance as the side edges of the slot in the intermediate portion.

* * * * *